United States Patent [19]

Hugonet

[11] 4,007,686

[45] Feb. 15, 1977

[54] CARTRIDGE CASING

[76] Inventor: Rene Gerard Hugonet, 36, rue Saint-Antoine, 91770 Saint-Vrain, France

[22] Filed: Mar. 26, 1975

[21] Appl. No.: 562,142

[30] Foreign Application Priority Data

Apr. 8, 1974 France ..... 74.12237

[52] U.S. Cl. ..... 102/44; 102/43 P

[51] Int. Cl.[2] ..... F42B 5/26

[58] Field of Search ..... 102/43 P, 44

[56] References Cited

UNITED STATES PATENTS 3,745,924 7/1973 Scanlon ..... 102/43 P

*Primary Examiner*—Stephen J. Lechert, Jr.

[57] ABSTRACT

Cartridge cases of the type which receive powder, a wadding and shot pellets are comprised of thermoplastic material and have a metal head. The head is joined to the plastic case body in an operation wherein heat and pressure are applied to cause the plastic material to flow both outwardly into the interior of a rim portion of the metal head and also inwardly into an annular recess defined in part by an internal reinforcing section of the case body. The reinforcing section of the case body may be either integral with or separable from the remainder of the cylindrically shaped case and the cylindrical portion of the case is provided with an extension which is deformed, by the application of heat and pressure during the manufacturing process, to form the element which locks the head to the plastic body.

6 Claims, 5 Drawing Figures

CARTRIDGE CASING

BACKGROUND OF THE INVENTION

1. Field of the Invention

The present invention relates to ammunition and particularly to cartridge cases intended to receive a charge of pellets. More specifically, this invention is directed to the manufacture of cartridge cases, shotgun shell cases for example, having a plastic side wall and a metal head. Accordingly, the general objects of the present invention are to provide novel and improved articles and methods of such character.

2. Description of the Prior Art

There have, in recent years, been numerous attempts to produce cartridge cases of the type used by sportsmen; i.e., shotgun shells; entirely of plastic material. Attempts to produce cartridge cases comprised entirely of plastic have been unsuccessful and it has been found preferable to reinforce such cases with a metal head or cap as is normal practice with conventional cardboard cartridge cases. The inclusion of a metal head avoids the risk that the plastic material, defining the sidewall of the cartridge, will break when the shot charge is expelled therefrom. Additionally, the metal head is necessary to eliminate expansion of the plastic portions of the case subsequent to firing of the ammunition. Such expansion, if permitted, will cause the casing to become jammed in the bore of the weapon and render extraction thereof exceedingly awkward and difficult.

The manufacture of plastic cartridge cases having a metal head has been found to be a relatively complicated operation. Substantial difficulty had been encountered in securely affixing the metal head to the plastic case body and, in numerous cartridges, it has been observed that the head and plastic case body separated during firing of the ammunition whereby the normal extraction of the cartridge case from the firearm could not be accomplished. The U.S. Pat. No. 3,565,008 describes a prior art method for securing a metal head to a cartridge case body comprised of plastic material. The technique of U.S. Pat. No. 3,565,008 is complex and thus time consuming and expensive since two separate sets of tools are required. The first set of tools is employed for forming the rough shape of the metal head and the second set of tools produces the finished head simultaneously with joining of the head to the cylindrical plastic case body. In order that the metal head be perfectly fixed to the plastic case body, it is essential for the second set of tools to be very precise in operation. Thus, if the cylindrical part of the metal head is not properly formed and/or if the rim on the head is inadequately defined, there will be insufficient deformation of the plastic case body during the assembly procedure to insure firm attachment of the metal head to the plastic body.

SUMMARY OF THE INVENTION

The present invention overcomes the above briefly discussed and other deficiencies and disadvantages of the prior art by providing an uncomplicated method for directly producing the metal head of a plastic cartridge case in its final form; the invention thus making it possible to dispense with one of the tool sets of the prior art. A cartridge case in accordance with the present invention is thus provided having a metal head which under normal circumstances will not separate from a plastic body portion.

The method in accordance with the invention relates to the production of sporting cartridge cases comprised of a cylindrical body of plastic material; which is intended to receive the powder, wad and shot; a reinforced base and a metal head with a rim. The base portion, which may be integral with the cylindrical body, cooperates with the metal head to define an annular groove which extends both inwardly and outwardly with respect to the side wall of the cylindrical plastic body. By means of the simultaneous application of heat and pressure to the metal head, while the head is pressed against a first end of the cylindrical plastic body, the said first end of the body is caused to flow into the above-mentioned annular groove; the internal surface of the rim of the metal head defining the outward extension of said groove. Thus, during the assembly process, an extension of the cylindrical plastic casing is softened and caused to deform into a generally T-shaped locking member which subsequently prevents separation of the metallic and plastic portions of the casing when detonated after having been loaded with powder and shot.

The sporting cartridge cases of the present invention, produced in accordance with the above summarized method, are formed from plastic material and have a reinforced base and a metal head with a rim. These cases are characterized by a cylinderical plastic body with a reinforced base portion; the cylinderical body preferrably being comprised of thermoplastic material and receiving the powder, wad and shot. The reinforced base portion may be either integral with or in the form of an insert in the cylindrical body and, in either event, the base portion of the casing is provided with a peripheral recess and a deformed end portion of the side wall of the cylindrical body extends both into this recess and also into the interior of the rim portion of the metal head. Restated, in an assembled shell, a part of the cylindrical plastic body of the case extends radially inwardly into an area defined by a recess in a reinforced base portion of the case and also extends radially outwardly into the interior of the rim portion of the metal head whereby firm attachment of the cartridge case to the head is insured.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figure 1:
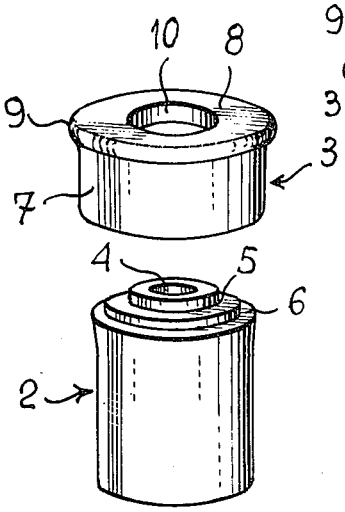
FIG. 1 is an exploded perspective view of the components of a cartridge case in accordance with a first embodiment of the invention.
Figure 2:
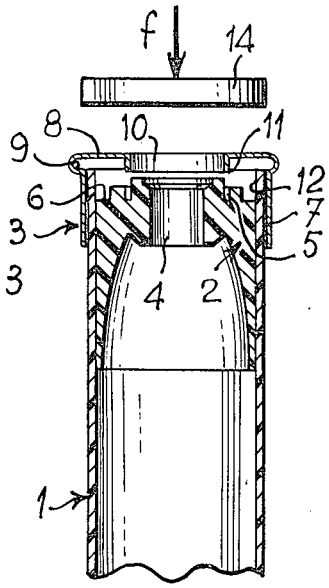
FIG. 2 is a cross-sectional, side elevation view of the cartridge case of FIG. 1 in an intermediate assembly stage.
Figure 3:
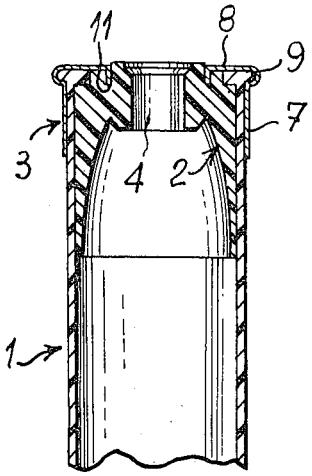
FIG. 3 is a cross-sectional side elevation view of the cartridge case of FIG. 1 in the fully assembled condition.
Figure 3:
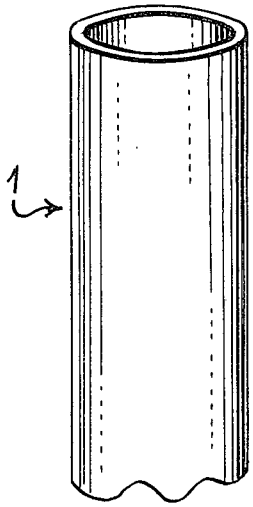
Figure 4:
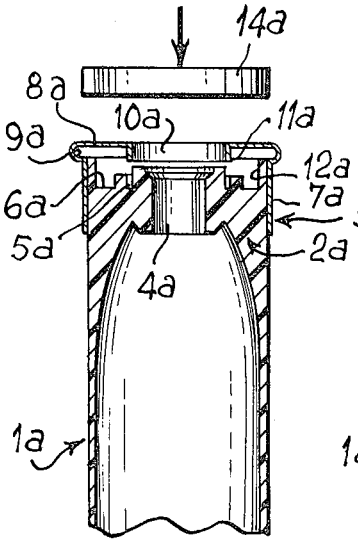
FIG. 4 is a cross-sectional, side elevation view of a second embodiment of a cartridge case in accordance with the present invention, FIG. 4 depicting the cartridge in an intermediate stage of assembly.
Figure 5:
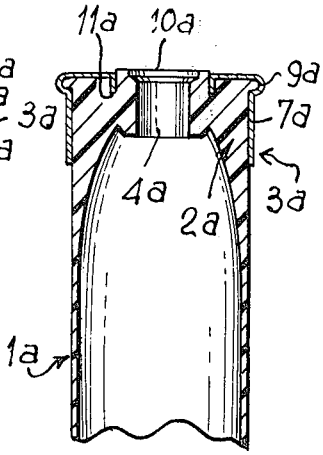
FIG. 5 is a cross-sectional side elevation view of the cartridge case of FIG. 4 in finished form.

Referring jointly to FIGS. 1–3, a cartridge case in accordance with the present invention consists of a molded cylindrical body 1 comprised of thermoplastic material such as, for example, polyethylene. The cartridge cases of the present invention further comprise a base or reinforcing element 2, which may be separable from body 1 as shown in FIGS. 1–3 or integral with the cylindrical body as shown in FIGS. 4 and 5, and a metal head 3.

The base element 2, which is also molded from a suitable plastic material, includes a central hole or bore 4 for receiving a cartridge cap or primer. Base element 2 is provided with an annular groove 5, which defines a neck portion which is received in an aperture in the head 3, and a peripheral recess defining rim or shoulder portion 6.

The cartridge head 3 is metallic, typically pressed steel, and includes a cylindrical portion 7 which is connected to a base 8 by means of a rim portion 9. The rim portion, as may best be seen from FIGS. 2 and 3, is of hollow construction and is intended for cooperation with a shoulder in the chamber of the firearm when the cartridge is inserted therein. The base portion 8 of head 3 is provided with a central hole 10, having a downwardly extending rim or edge 11, which receives neck portion 5 of base element 2.

In order to assemble a cartridge case in accordance with the embodiment of FIGS. 1–3, the base element 2 is inserted in the cylindrical plastic case 1 in such a manner as to leave a portion 12 of the cylinder extending above base 2. The head 3 is then positioned on the case 1, as shown in FIG. 2, with the plastic cylinder being inside of the cylindrical side wall 7 of the head. Thereafter, a heating element, indicated schematically at 14, is brought into contact with the metal head 3 and pressure is applied in the direction indicated by arrow *f;* the heating element 14 being in the form of a ring. Heat is transmitted, via the base 8 of head 3, from the tool 14 to the extension 12 of the plastic cylinder 1. The thus heated plastic will soften and flow outwardly into the internal area of the rim 9 of head 3. Simultaneously, the softened plastic material from cylinder 1 will flow inwardly to fill the void defined by the head 3 and the peripheral recess 6 on base element 2. At the same time the downwardly turned edge 11 of the central hole in the base of head 3 is urged downwardly into the annular groove 5 in base element 2. The application of heat and pressure thus produces the finished product depicted in FIG. 3 wherein an end of the cylindrical plastic body 1 has been formed into a generally T-shaped locking member and the elements of the casing are securely interlocked in an uncomplicated and inexpensive manner.

In a second embodiment of the invention, as depicted in FIGS. 4 and 5, the cylindrical plastic body portion 1*a* of a cartridge case is integral with the base portion 2*a;* the portion 2*a* including a central bore 4*a*, an annular neck defining groove 5*a*, a recessed shoulder portion 6*a* and an upward extension 12*a*. In the embodiment of FIGS. 4 and 5 the metal head, indicated generally at 3*a*, is identical to the head of the embodiment of FIGS. 1–3 and comprises a base portion 8*a*, a downwardly extending sidewall 7*a*, a rim 9*a* and a central hole 10*a* with a downwardly turned rim or edge 11*a*.

Assembly of the embodiment of FIGS. 4 and 5 is identical to the assembly procedure described above with a ring-shaped heating element 14*a* being employed to cause softening and flowing of the extension 12*a* of the plastic member. A portion of the plastic cartridge case body will thus be deformed so as to fill the internal area of rim 9*a* of head 3*a* and to also fill the void defined by recess 6*a* between the plastic portion of the casing and the inside of head 3*a*. The finished product is shown in FIG. 5.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A cartridge case comprising:

a metal head, said head including a cylindrical forward portion, a base portion oriented generally transverse to the axis of said cylindrical portion and a rim portion interconnecting said base and cylindrical portions, said rim portion extending outwardly with respect to said cylindrical portion to define a circular groove facing said axis of said cylindrical portion; and charge receiving body means, said body means being comprised of thermoplastic material and being of cylindrical shape, said body means having an outer diameter commensurate with said head cylindrical portion inner diameter and being received in said head cylindrical portion, said body means having a thin walled tubular portion which extends forwardly from said head cylindrical portion coaxially therewith, said body means also having a base portion of increased wall thickness which terminates in abutting relationship with said head base portion, said body means base portion having an outwardly extending integral flange which is engaged in said head rim portion circular groove thereby locking said head to said body means.

2. The cartridge case of claim 1 wherein said outwardly extending flange of said body means results from distortion of a cylindrical shaped extension of said body means under the influence of heat and pressure, said extension projecting upwardly from said body means base portion prior to distortion.

3. The cartridge case of claim 2 wherein said body means comprises:

a tubular member; and an insert within said tubular member, said insert defining said body means base portion, said insert being provided with an axial passage therethrough and an annular groove, said annular groove facing said head base portion.

4. The cartridge case of claim 3 wherein said head further includes a central opening, said opening being bounded by a downwardly extending rim, said opening being coaxial with the axial passage in said insert and said downwardly extending rim being received in said insert annular groove.

5. A cartridge case as in claim 2 wherein said head further comprises a central opening and a downwardly turned edge about the periphery of said central opening.

6. The cartridge case of claim 5 wherein said body means base portion has an axial passage coaxial with said head base portion central opening, said body means base portion further being provided with an annular groove which faces said head base portion, the downwardly turned edge of the opening in said head base portion being received in said body means annular groove.

* * * * *